United States Patent [19]

Knox

[11] 4,105,167

[45] Aug. 8, 1978

[54] CABLE SPINNING

[75] Inventor: Hugh Stewart Geddes Knox, Croft, England

[73] Assignee: The Cleveland Bridge & Engineering Co., Ltd., Darlington, England

[21] Appl. No.: 749,393

[22] Filed: Dec. 8, 1976

Related U.S. Application Data

[60] Division of Ser. No. 547,404, Feb. 5, 1975, Pat. No. 4,012,001, which is a continuation-in-part of Ser. No. 385,580, Aug. 3, 1973, abandoned.

[30] Foreign Application Priority Data

Aug. 4, 1972 [GB] United Kingdom ..... 36617/72

[51] Int. Cl.[2] ..... B65H 75/00

[52] U.S. Cl. ..... 242/54 R; 254/134.3 R; 254/184

[58] Field of Search ..... 242/54 R, 55, 85, 86, 242/86.5 R, 86.5 A, 86.51, 86.52, 86.7, 86.8, 158–158.5; 254/134.3 R, 134.3 CL, 134.5, 184, 185 R, 185 B

[56] References Cited

U.S. PATENT DOCUMENTS

| | | | |
|---|---|---|---|
| 938,772 | 11/1909 | Lambert | 254/185 R |
| 1,182,757 | 5/1916 | Degerstedt | 254/185 R |
| 1,383,704 | 7/1921 | Evers | 254/185 R |
| 1,608,994 | 11/1926 | Pierson | 254/185 B |
| 2,008,612 | 7/1935 | Heath | 242/86.7 X |
| 2,991,024 | 7/1961 | Goode | 242/86.5 R |
| 3,073,574 | 1/1963 | Garnett | 242/86.5 R X |
| 3,520,489 | 7/1970 | Flowers | 242/86.5 R |

*Primary Examiner*—Stanley N. Gilreath
*Attorney, Agent, or Firm*—Haseltine, Lake, & Waters

[57] ABSTRACT

A method for reeling and unreeling wire for use in the aerial spinning process for forming suspension cables in the construction of a suspension bridge. The method provides for unreeling wire for the suspension cable from a permanently mounted first reel of a reeling and unreeling machine while simultaneously reeling wire onto a permanently mounted second reel of the reeling and unreeling machine. When the first reel is emptied and the second reel is filled, wire is unreeled from the second reel and wire is reeled onto the first reel. The first and second reels are driven independently of each other at variable speeds according to the needs of the reeling and unreeling processes.

1 Claim, 4 Drawing Figures

FIG.3.
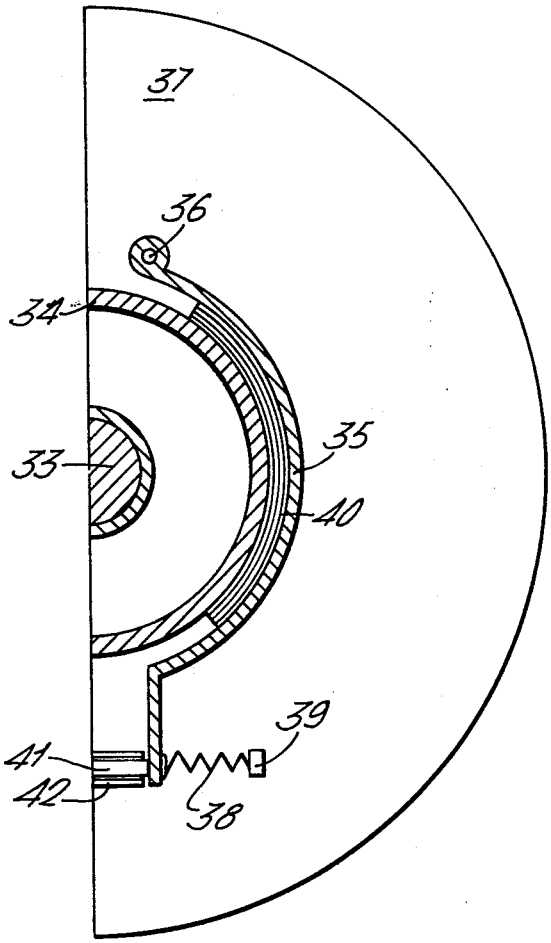
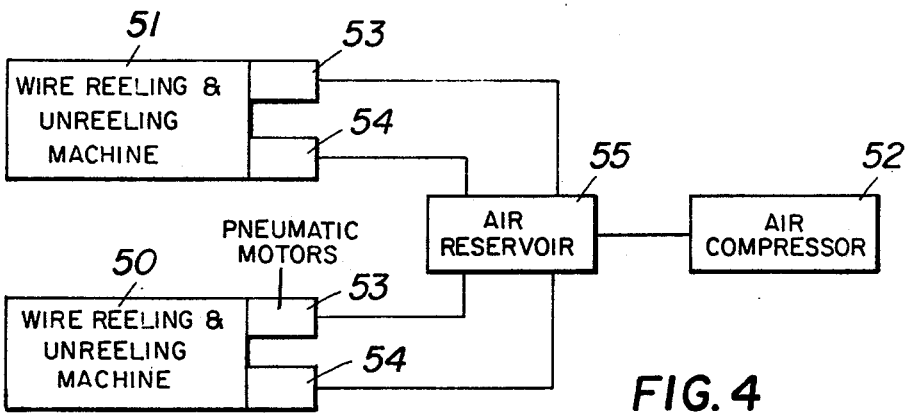
FIG. 4

CABLE SPINNING

This is a division of application Ser. No. 547,404 filed Feb. 5, 1975, now U.S. Pat. No. 4,012,001 which is a continuation-in-part application of Ser. No. 385,580, filed 8/13/73, abandoned.

BACKGROUND OF THE INVENTION

This invention relates to a method for use in reeling and unreeling wire for use in the aerial spinning process for forming suspension cables for suspension bridges.

DISCUSSION OF THE ART

When constructing a suspension bridge, considerable lengths of wire are required for suspension cables. In the so-called aerial spinning process wires are drawn from reels and led across the gap to be spanned by the bridge. Suitable wire for suspension cables is of about 5 mm diameter and is supplied by manufacturers in coils of 1 ½ meter nominal diameter which usually weigh between ¼ and 1 ton. The length of wire in each coil is variable and the wire will not normally run easily from such a coil. To provide a sufficient length of wire for use in the aerial spinning process, several lengths of wire as supplied by a manufacturer have to be spliced together. It is most inconvenient, when leading wire across a gap, to interrupt operations at irregular intervals to splice together lengths of wire. Therefore, it is usual to take wire from several coils as supplied by the manufacturer and to coil these on a large reel, splicing the wires together as they are led onto the reel. Thus there can be obtained a reel bearing a known length of wire which is carefully wound so that it will run freely from the reel when desired. This has led to provision of reeling machines comprising means to support a reel for rotation of the reel and a drive motor to rotate the reel during the reeling operation. The filled reel is then removed from the reeling machine and, when required, is placed on an unreeling machine and the wire is unreeled and is used in the bridge construction. It will be appreciated that the unreeling machine must be at the construction site but the reeling machine need not be. Filled and empty reels are transported between the reeling and unreeling machines. Thus it is necessary to supply a considerable number of reels, sufficient to keep the unreeling machines at the construction site filled, plus those being filled at the reeling machines and those in transit between the reeling and unreeling machines.

The cost of reels and of the operations of mounting an empty reel on a reeling machine, reeling wire, demounting the filled reel, transporting the filled reel to a reeling machine and mounting the filled reel are all considerable. Therefore there has been a tendency to increase the size of the reels and the amount of wire which they can carry. This reduces the number of reels required and the number of times the above-mentioned operations have to be carried out but, owing to the increases in weight of the larger reels carrying more wire, the difficulties of carrying out the operations are increased. Filled reels have ranged in weight from about 8 to about 26 tons.

SUMMARY OF THE INVENTION

According to the present invention there is provide a machine for reeling and unreeling wire for use in the aerial spinning process for forming suspension cables in the construction of a suspension bridge, which machine comprises a frame including two substantially horizontal support means, two permanently mounted reels for reeling and unreeling the said wire, each reel being mounted on one of the side horizontal support means and capable of rotation about the horizontal support means in either direction and variable speed drive means for each reel including a positive driving connection to each reel for driving the reel in either direction.

DESCRIPTION OF THE PREFERRED EMBODIMENTS

When using the method in accordance with the invention reels are permanently mounted. Hence no more reels are required than can be accommodated on the number of machines desired for unreeling. As reeling and unreeling are carried out on the same machine filled reels, weighing from 8 to 26 tons, do not require to be lifted. The largest weight which must be lifted is that of a coil supplied by a wire manufacturer. Furthermore, when using the method of the invention, switching from using wire from one reel to using wire from the other reel of a machine is a simple operation which involves no significant loss of time. Hence the reels and the amount of wire carried do not require to be so great for economic operation as in the prior art. Reels carrying only 2 tons of wire when fully wound can be used although it is preferred to use reels carrying 3½ to 4 tons of wire when fully wound.

In accordance with the present invention, the method for reeling and unreeling wire for use in an aerial spinning process forming suspension tables in the construction of a suspension bridge provides for a frame that includes a non rotatable shaft. Two permanently mounted reels for reeling and unreeling the wire are each mounted on the non rotatable shaft, and are rotatable about the shaft in either direction. Each reel is provided with separate and independent reversable variable speed drive including a positive driving connection to each reel for the purpose of driving each reel in either direction of rotation independently of each other.

The machine is capable of supporting two reels which can each rotate independently of the other. Thus reeling can be taking place on one reel simultaneously with unreeling from the other reel. As soon as the one reel is emptied, the end of the wire can be spliced to the wire on the other reel and the aerial spinning process can continue. Thus when a reel is emptied the process is interrupted only for the time taken to splice two wires together, approximately one minute. The emptied reel can be filled, ready for re-use, while the filled reel is emptied. It is an important feature of the machine that it can reel wire as fast as it is desired to unreel the wire, so that formation of the suspension cables can be carried out continuously, without waiting for reels to be filled. The speed of unreeling may be as much as 700 meters per minute. The reels should have a diameter of at least about 1½ meters, preferably at least about 2 meters. This is desirable to avoid winding the wire, which is stiff wire of about 5 mm diameter, too tightly about the barrel of the reel and possibly straining the wire, and also to prevent the wire springing off the barrel of the reel. The width across the barrel of each reel is also limited, and also the distance between the two reels mounted on the machine. This is because wire from either reel is led during unreeling around the same sheave at the top of a tower. There are limits to the angle at which the wire can approach the sheave, so the area from which the wire can approach the sheave is correspondingly limited. The width of each reel should not be greater than about 850 mm, preferably not greater than 500 mm and the distance across the two reels on the machine should not be greater than about 2 meters, preferably not greater than 1.3 meters.

Preferably the machine for carrying out the method of the present invention comprises one frame and one support shaft, both reels being supported on the same shaft but being capable of rotation independently. A drive means and a braking system is provided for each reel to permit control of the reeling and unreeling operations. As stated above, the speed of unreeling may be as much as 700 meters per minute and the desired speed at any moment can change rapidly. Therefore a variable speed drive means capable of rapid acceleration and decceleration and having a positive driving connection between the motor and the reel is required. The drive can be provided from any suitable engine or motor, for example internal combustion, electric, hydraulic or pneumatic. A pneumatic motor is preferred. A pneumatic motor having five pistons in a radial configuration and manufactured by the Globe Pneumatic Engineering Company, Romford, Essex, England is suitable.

DESCRIPTION OF THE ILLUSTRATED EMBODIMENTS

The invention will be further illustrated by reference to the accompanying drawings showing, by way of example, an embodiment of the invention, in which:

FIG. 3 is a cross-sectional elevation in simplified and diagrammatic form of an automatic brake which is part of the machine.

FIG. 4 is a schematic view of an arrangement in which two machines are operatively connected to a common air compressor and air reservoir.

Figure 1:
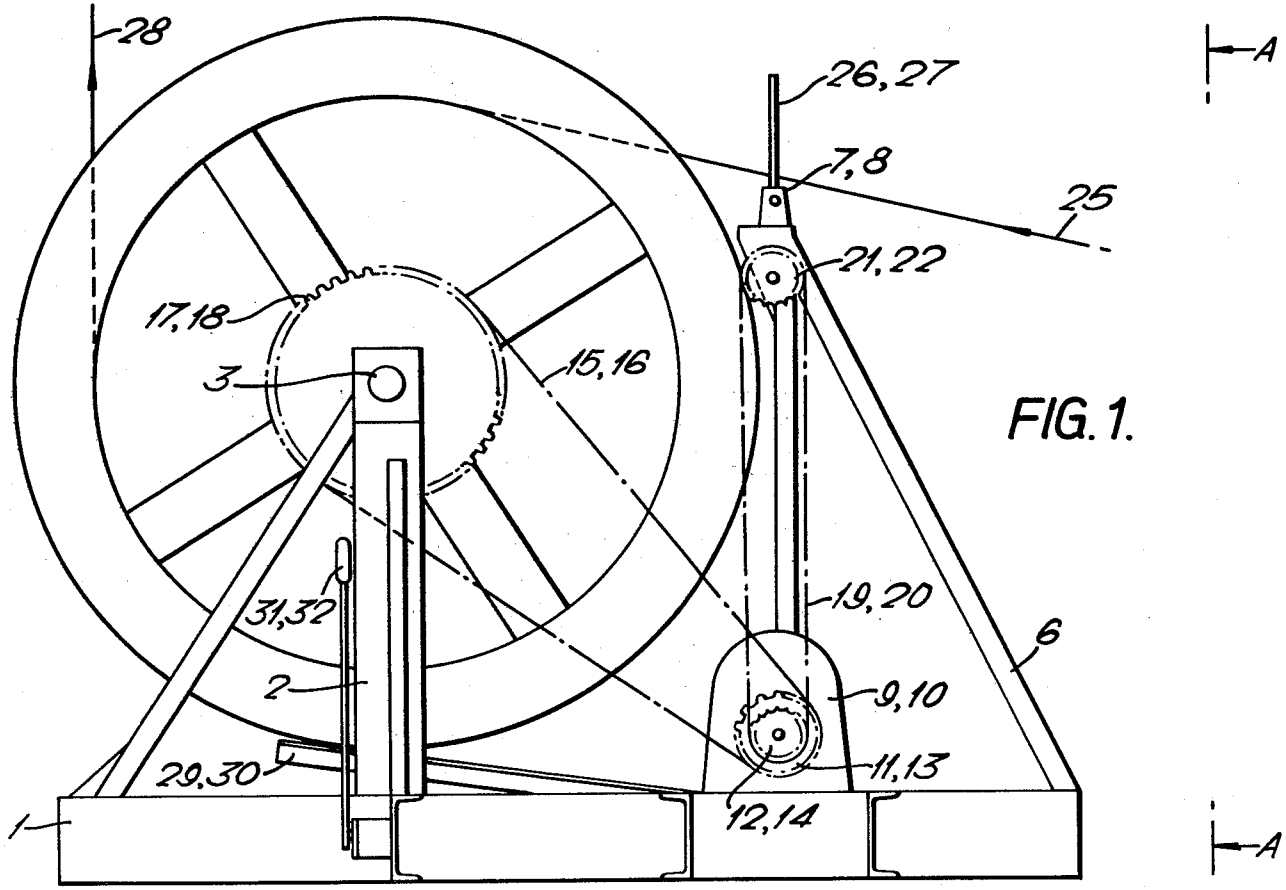
FIG. 1 is a side elevation of a machine for carrying out the method of the present invention.
Figure 2:
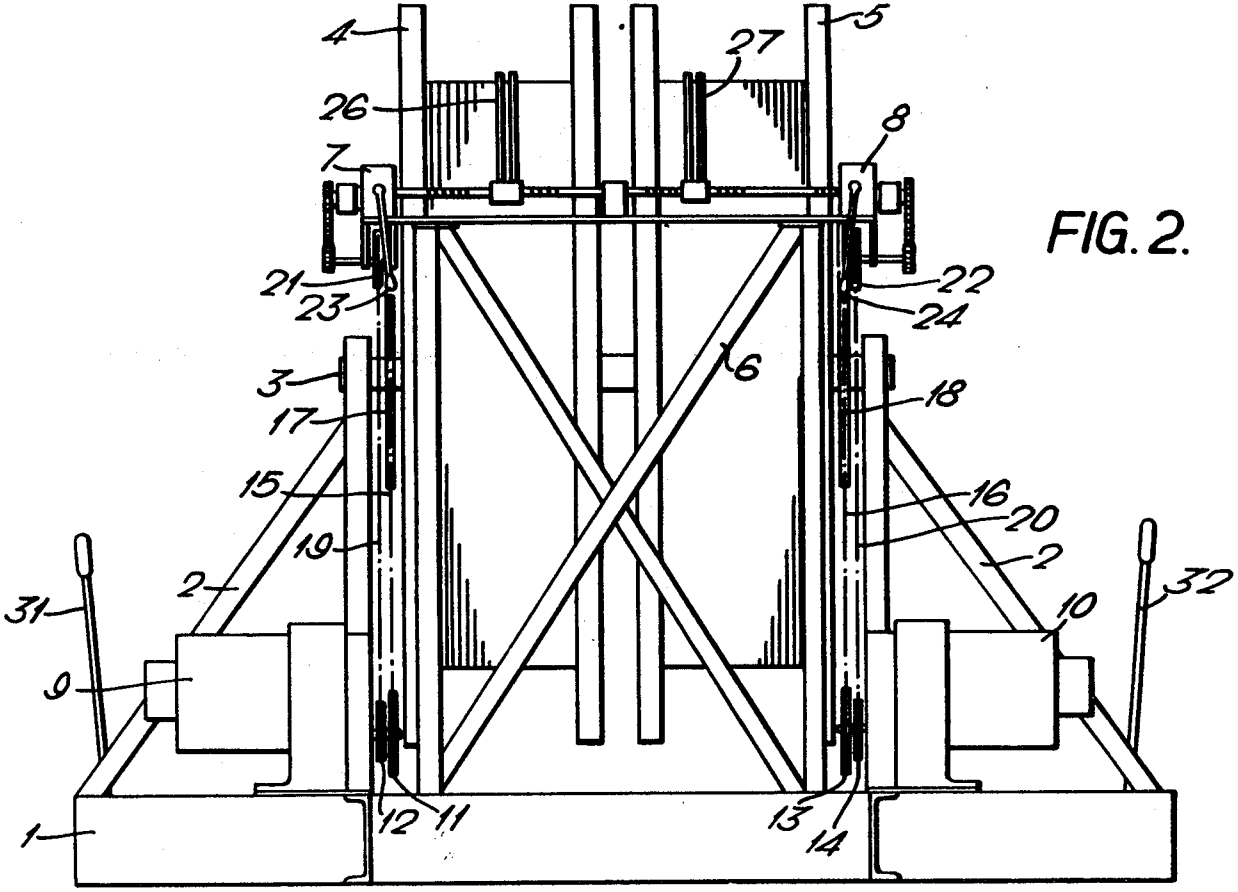
FIG. 2 is an end elevation looking in the direction A—A shown in FIG. 1.

A base frame 1 of welded steel construction carries braced reel support posts 2 supporting a fixed shaft 3. This shaft 3 carries two steel reels 4 and 5 running on suitable bearings on the shaft. The base frame 1 also carries fleeter support frame 6 on which are mounted two gear and screw devices 7 and 8 for fleeting the wire across the reels 4 and 5 respectively. On the base frame 1 are also mounted pneumatic motors with suitable gear boxes, 9 and 10. The output shaft of motor and gear box 9 carries sprocket pinions 11 and 12 and the output shaft of motor and gear box 10 carries sprocket pinions 13 and 14. Sprocket pinion 11 is connected by a drive chain 15 to a sprocket wheel 17 attached to reel 4 and sprocket pinion 13 is connected by a drive chain 16 to a sprocket wheel 18 which is attached to reel 5. Sprocket pinion 12 is connected by a drive chain 19 to sprocket wheel 21 which drives fleeter 7 and sprocket pinion 14 is connected by a drive chain 20 to sprocket wheel 22 which drives fleeter 8. Lever 23 permits fleeter 7 to be engaged when it is designed to wind wire onto reel 4 and lever 24 permits fleeter 8 to be engaged when it is desired to wind wire onto reel 5. The wire to be reeled 25 is led from a suitable uncoiling device and passes through either the guide rollers 26 driven by fleeter 7 onto reel 4 or alternatively through the guide rollers 27 driven by fleeter 8 onto reel 5. The wire to be unreeled led upwards, is ledupwards, on the opposite side of the machine to the fleeters, from either reel 4 or reel 5 whichever is not in use for reeling at that time, suitable sheaves directing it in the desired direction. An emergency brake 29 operated by lever 31 is provided for the purpose of stopping reel 4 in the event of a failure of the normal control system to be described later and brake 30 operated by lever 32 for stopping reel 5 in similar circumstances.

The pneumatic motors 9 and 10 are each capable of being driven in either direction of rotation and at speeds variable from a standstill to the maximum design speed of the machine. Preferably the pneumatic motors are piston motors with five cylinders in a radial arrangement. In the machine as seen in FIG. 1 the reels will be driven anti-clockwise for reeling purposes and will be driven, or allowed to rotate, clockwise for unreeling purposes. The pneumatic motors can also provide any braking necessary by being driven in the appropriate direction. However, pneumatic motors 9 and 10 may also include automatic brakes which will slow down and stop the reels when the air supply is disconnected.

The automatic brake is shown in FIG. 3. A brake wheel 34 is integral with the drive shaft 33 from the motor. Two arcuate brake bands 35 are mounted at one end on a pivot 36 on a flange 37. Each brake band 35 is urged towards the brake wheel 34 by a spring 38, which acts between the brake band and a stop 39 on the flange 37. A brake lining 40 is mounted on the inside face of each brake band so that it is urged into contact with the brake wheel 34 by the spring 38. A piston 41 and cylinder 42 are provided, the cylinder being mounted on the flange 37. The piston-cylinder assembly is pneumatically operated. When compressed air is supplied to drive the motor, compressed air is also provided to the piston-cylinder arrangement and the piston urges the brake band 35 away from the brake wheel 34, against spring 38. When the motor is not being driven compressed air is not supplied to the piston-cylinder assembly. Consequently the spring 38 urges the brake band 35 towards the brake wheel 35 so that the brake lining 40 contacts the brake wheel and the brake automatically comes into effect.

The controls for direction, speed and braking of the pneumatic motors can be mounted at a convenient distance from the machine to permit proper observation of the wire being reeled and unreeled.

For the cable spinning process in the construction of a suspension bridge two or more machines may be used; it is usual that four or more of the described machines are required in order to feed the required number of wires at a time into the cables but it is usual that all the reels to these machines are not required to be operated under maximum power at the same time. Advantage can be taken of this in order to reduce the size of the air compressing installation by providing between the air compressors and the pneumatic motors air reservoirs of suitable capacity.

I claim:

1. In a method of forming suspension cables from wire by an aerial spinning process in the construction of a suspension bridge, the improvement comprising the steps of: unreeling wire for a suspension cable from a permanently mounted first reel of a reeling and unreeling machine by driving said first reel in a forward direction while simultaneously reeling wire onto a permanently mounted second reel of the reeling and unreeling machine by driving said second reel independently of said first reel, unreeling wire from the second reel and reeling wire onto the first reel when the first reel is emptied and the second reel is filled by driving said first and second reels independently of one another and in directions of rotation opposite to their respective initial directions of rotation, and driving said first and second reels with separate, independent and reversible drive means for each of said first and second reels.

* * * * *